United States Patent [19]

Cadmus, Jr.

[11] 3,949,672

[45] Apr. 13, 1976

[54] DEVICE FOR MOUNTING INTERCHANGEABLE TYPE

[76] Inventor: Harold Cadmus, Jr., 533 Merriman's Lane, Winchester, Va. 22601

[22] Filed: Aug. 30, 1973

[21] Appl. No.: 393,173

[52] U.S. Cl. ..... 101/368; 101/370; 101/375; 101/380

[51] Int. Cl.[2] ..... B41F 27/04; B41F 27/06

[58] Field of Search ..... 101/380, 370, 377, 381, 101/368; 40/142 R, 143, 156, 145 R, 145 A, 23; 24/208, 213, 214

[56] References Cited

UNITED STATES PATENTS

| | | | |
|---|---|---|---|
| 927,873 | 7/1909 | Reynolds | 101/368 |
| 1,310,119 | 7/1919 | Harper | 24/208 A |
| 1,858,480 | 5/1932 | Chisholm | 101/368 X |
| 1,915,249 | 6/1933 | Jorgensen | 24/213 R |
| 1,976,714 | 10/1934 | Chisholm | 101/142 |
| 2,209,403 | 7/1940 | Kittner et al. | 24/214 |
| 2,397,801 | 4/1946 | Mitchell | 24/213 R |
| 2,731,915 | 1/1956 | Garvey | 101/368 |
| 2,851,078 | 9/1958 | Mellon et al. | 24/213 R X |
| 2,877,707 | 3/1959 | Munson | 101/380 |
| 2,895,199 | 7/1959 | Jones | 24/213 R |
| 2,896,889 | 7/1959 | Hershberger et al. | 24/208 A X |
| 2,962,964 | 12/1960 | Munson | 101/380 |
| 3,012,501 | 12/1961 | Munson | 101/381 |
| 3,099,213 | 7/1963 | Munson | 101/380 |
| 3,151,554 | 10/1964 | Townsend | 101/415.1 |
| 3,195,201 | 7/1965 | Ash | 24/208 A |
| 3,210,820 | 10/1965 | Humiston | 24/208 A |
| 3,255,697 | 6/1966 | Cunningham | 101/383 X |
| 3,494,244 | 2/1970 | Wayland | 24/208 A X |
| 3,597,099 | 8/1971 | Tollin et al. | 101/368 X |

*Primary Examiner*—Edgar S. Burr
*Assistant Examiner*—Paul J. Hirsch
*Attorney, Agent, or Firm*—Bacon & Thomas

[57] ABSTRACT

A device for mounting interchangeable type including a pair of spaced, resilient retainer members disposed on a backing member. Each retainer member has a neck portion and a head portion. One or more thin, elongated, flat bands, each having a pair of spaced openings therein, may slidably receive a plurality of interchangeable printing members thereon. The head portions of the retainer members are passed through the openings in each band to retain each band on the backing member.

21 Claims, 4 Drawing Figures

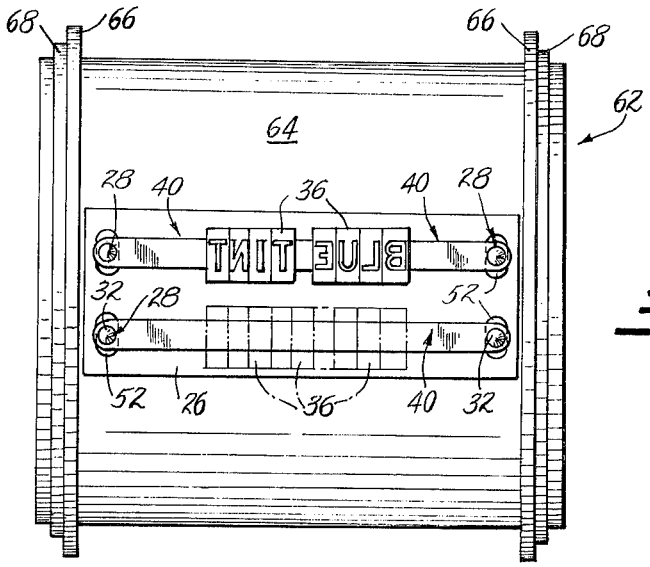
Fig. 8.
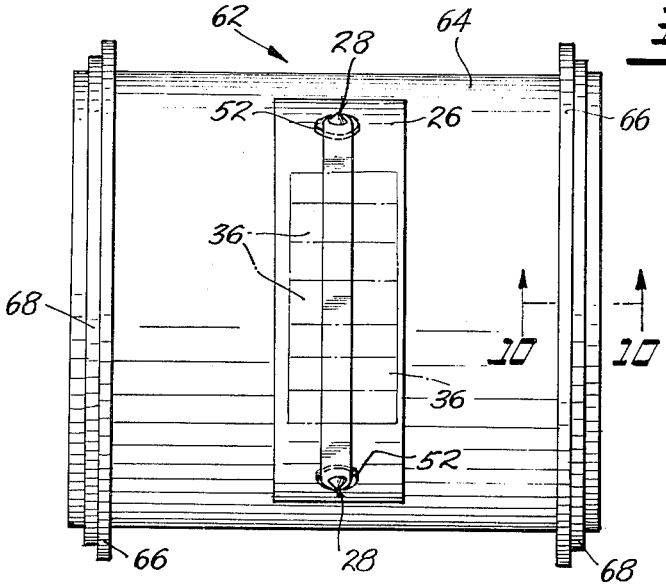
Fig. 9.
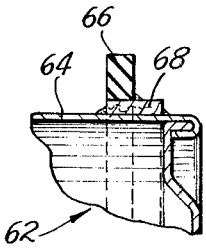
Fig. 10.
Fig. 11.
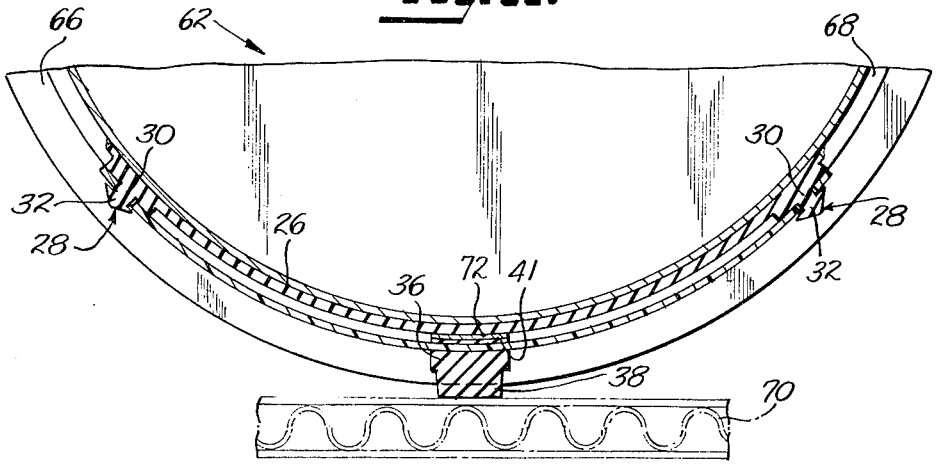

DEVICE FOR MOUNTING INTERCHANGEABLE TYPE

BACKGROUND AND OBJECTS OF THE INVENTION

1. Field of the Invention

The present invention relates to a device for detachably mounting, on a backing member, interchangeable rubber type or type made of a similar resilient material. The invention can be used to advantage either with conventional hand-stamping devices or with more advanced, rotary printing devices.

The type of rotary printing application in which the present invention may be used to best advantage is illustrated in U.S. Pat. No. 3,128,700 to L. S. Kunetka and U.S. Pat. No. 2,771,031 to R. W. Knapp. These patents both describe the use of rubber print in connection with rotary printing drums or rollers. As discussed in the Kunetka patent, rubber print is particularly useful in the art of printing upon certain types of sheet materials, such as corrugated cardboard or the like, which may be crushed by more conventional metal printing plates.

In either a hand stamping or a rotary printing application, the kind of fastening, retaining or mounting device which can be used successfully is rather restricted. First of all, it is important that no part of the mounting device project outwardly from the body further than the distance which the print characters protrude therefrom. Secondly, it is important and desirable that the printing members be easily attachable to the body of the device in a very secure manner whereby the lateral forces exerted during a printing or stamping operation will not loosen or displace the printing members from the body of the device. Thirdly, it is important that the printing members be readily detachable from the device so that the printing characters may be interchanged and rearranged and so that reattachment thereof may be readily accomplished. Fourthly, the arrangement should be such that the same basic elements may be used repeatedly, these elements also being capable of use in different printing and/or stamping applications.

2. Description of the Prior ARt

Devices for mounting a plurality of interchangeable rubber printing members have theretofore been proposed.

U.S. Pat. Nos. 3,099,213, 2,962,964, 2,877,707 and 2,859,694, all to W. K. Munson, disclose stamping devices wherein a plurality of rubber printing members are guidably strung onto one or more elongated rods or bars which, in turn, are secured at each end thereof to the body of a stamping device. In each instance, the arrangement of components for fastening the rod or bar to the body of the stamping device is relatively complex and/or costly, particularly when compared with the very simple and inexpensive device of the present invention. Moreover, the fastening means disclosed by each of the above patents is not readily adaptable to different printing or stamping applications. For example, none could be applied in a practical and advantageous manner to rotary printing applications. Furthermore, all of the devices disclosed in the foregoing patents are intended only for securing metal rods or bars of relatively large cross-section to the body of the stamping apparatus. None would be suitable for fastening a thin, flexible band to the body of a stamping or rotary printing device. The use of such a band in connection with rubber printing elements has special advantages which will be described hereinafter.

U.S. Pat. No. 2,222,333 to Wenzel et al. discloses a system for mounting rubber type to a base member. Both the type itself as well as the base member have a plurality of complementary, interlocking, parallel ridges. The fact that each of the many ridges associated with a single piece of type must be pressed within the corresponding grooves between the ridges of the base member, makes the assembly or composition of plural printing members a rather time consuming operation. This is particularly so in view of the ease and speed with which slotted rubber pieces of type can be strung onto a band, and the facility with which the band, in turn, may be snapped into place on a backing member.

Of course, in an application wherein the type-holding arrangement of Wenzel et al. is used, the printing apparatus must be shut down during the entire time required for rearranging another set of type elements to print different information in a new printing operation. With this system it is not possible, during one printing operation, to completely rearrange the type for the next operation.

OBJECTS OF THE INVENTION

It is an object of the present invention to provide a device for mounting interchangeable type which is simple in construction and inexpensive to manufacture.

It is also an object of the present invention to provide a device wherein a plurality of printing members may be quickly and easily attached or detached from a backing member.

It is another object of the invention to provide a device for mounting interchangeable type, which mounting device combines ease of attachment and detachment with secureness of retention.

It is a more particular object of the invention to provide a device for attaching a thin band, having arranged thereon a plurality of printing elements, to a backing member disposed upon the body portion of a printing or stamping device, whereby the band may be either secured or released by application of a relatively small force perpendicular to the surface of the backing, but will not be released upon application of a relatively large lateral force of the magnitude encountered during printing and/or stamping operations.

It is yet another object of the invention to provide a device suitable for detachably securing, to a backing, a thin, flat, relatively flexible band upon which a plurality of printing elements are strung.

It is also an object of the invention to provide a device wherein a band, upon which a plurality of printing elements are secured, is prevented from movement about its longitudinal axis when secured to a backing member.

It is another object of the invention to provide a device wherein a band, with printing elements arranged thereon, is secured by retaining means disposed directly on a backing member thereby eliminating the need for retaining or fastening means associated with the body portion of the printing or stamping device.

These and other objects of the invention will be apparent from the following specification, claims and drawings.

SUMMARY OF THE INVENTION

In the device of the present invention, the shortcomings of prior art devices are eliminated and the foregoing objects are achieved. The device of the invention includes a thin, flat band and a plurality of printing members made of rubber or the like. Each printing member includes a transversely elongated slot extending therethrough, the cross-section of each slot corresponding approximately to the cross-section of the band. The printing members are arranged or strung on the band such that the band passes through each of the slots of the various members.

The use of a thin, flat band provides particular advantages in that suitable stock material is inexpensive and readily available. Such material requires only very minor modifications to adapt the same for use in the present environment, thereby obviating costly manufacturing steps. Furthermore, the very large surface area presented by a flat band greatly enhances the grip between the band and the tightly fitting slots of the resilient printing members. The result is a very secure retention of the printing members on the printing or stamping device.

Each thin, flat band of the invention includes at least one pair of openings therein, one opening being disposed near each end of the band. A backing member affixed to the body portion of a printing or stamping device includes at least one pair of resilient retainer members which are arranged for cooperation with the openings in each band. Each retainer member includes a head portion and a neck portion. The head portion forms the free end of each retainer member and defines a shoulder with respect to the neck portion. The openings in one or more bands may be brought into registry with corresponding protruding retainer members whereby the head portion of each retainer member may be passed through each opening. In this fashion, one or more bands, each with a plurality of printing members strung thereon, may be secured to a backing member which, in turn, is disposed on a printing or stamping body.

In one embodiment, the head portion of each retainer member has a generally frusto-conical configuration, yet the free end thereof has a convex configuration. In this embodiment, the openings in each band are generally circular in configuration. When the openings are aligned with the retainer members, a manually applied downward force on the band in a direction perpendicular to the surface of the backing will cause each opening to move downwardly on the head portion, effecting deformation of the head portion to such an extent that it passes entirely through the opening. Once through the opening, the head portion returns to its original, undeformed shape so that the shoulder between the head portion and neck portion secures the band tightly on the neck portion.

With a retainer member of this type, the band may also be quickly and easily removed by application of a relatively light force in an upward direction perpendicular to the backing. However, the retainer provides an especially secure holding action against laterally applied forces; that is, forces in a direction generally parallel or tangential to the backing. These types of forces are often encountered in both hand stamping and rotary printing applications, particularly in the latter application where the circumferential velocity of the printing drum generates significant tangential forces on the type elements. In either rotary printing or hand stamping applications, the ease with which the band of the present invention may be snapped on or off the backing member in no way diminishes the holding power of the retainer members against lateral forces.

In another embodiment, the head portions of the retainer members are elongated in a direction perpendicular to the central axes of the retainer neck portions and the openings in the bands have correspondingly elongated configurations. To secure a band on the backing member, each elongated head portion is deformably rotated, as by twisting, into registry with each associated opening in the band. The rotated head portion is passed through the associated opening, after which the head portion is allowed to return to its relaxed position thereby securing the band in place.

Between the backing member on the printing and stamping device and each retainer member, there is provided a base of a width greater than or equal to the width of a band. Each base engages the underside of a band which has been secured in place by a pair of retainer members. Each base acts as a platform for securely holding one end of the band and preventing rotation thereof about its longitudinal axis.

BRIEF DESCRIPTION OF THE DRAWINGS

FIG. 8 is an elevational view, showing the printing members mounted on the periphery of a printing drum parallel to the axis thereof;

FIG. 9 is an elevational view, showing the printing members circumferentially mounted on the periphery of a printing drum;

FIG. 10 is an enlarged fragmentary vertical sectional view taken on the line 10—10 of FIG. 9; and FIG. 11 is an enlarged fragmentary sectional view through one end of the printing drum.

DETAILED DESCRIPTION OF THE DRAWINGS

Figure 1:
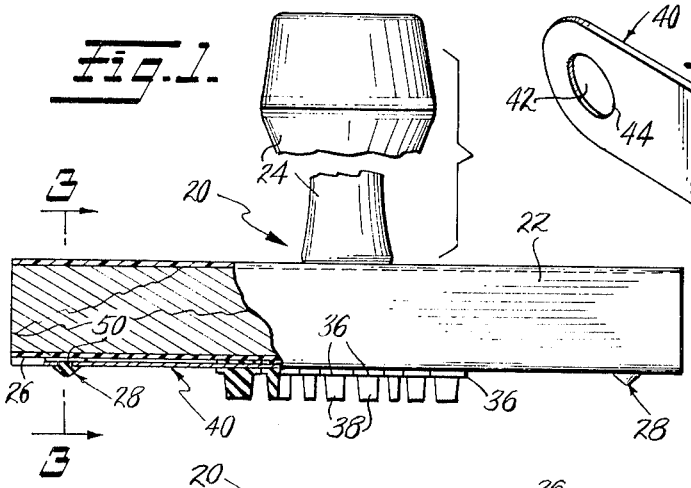
FIG. 1 is a fragmentary elevational view, partly in section, of the device of the present invention as applied to a rubber hand stamp.

In the following description and in the drawings, it is to be understood that like numerals, used in connection with different figures, refer to like elements or features.

Referring to FIGS. 1–6 there is depicted a hand stamp device generally desiganted by reference numeral 20. A body portion 22 of the hand stamp 20 includes a conventional handle 24 on one side. On the side of the body portion opposite the handle, there is mounted a backing member 26 which, preferably but not necessarily, is elongated and extends the length of one side of the body portion 22.

Upon the backing member 26, there is disposed at least one pair of retainer members, each retainer member being generally referred to by reference numeral 28. Each retainer member is composed of rubber or a similar resilient material and is preferably formed as an integral part of the backing member. Also, each retainer member 28 includes a neck portion 30 adjacent the backing member and extending outwardly therefrom. A head portion 32 joins each neck portion and has, at least at some point, a cross-sectional area larger than that of the neck portion. As may be best seen in FIGS. 3A and 5A, each head portion 32 forms an annular shoulder 34 with respect to each neck portion 30. It will be apparent from FIGS. 3 and 3A that each retainer member has a solid cross-section and that the interior of each retainer member is without cavities and is not hollow. Similarly, each retainer has no openings, splits or breaks therein.

A plurality of printing members 36, having characters 38 thereon, are strung on a thin, relatively flexible band 40, the band 40 passing through elongated slots 41 in each member 36. the band 40, in turn, is secured to the backing member 26 by the retainer members 28. Each band has at least one pair of openings 42 therein, each opening being disposed adjacent one end of the band 40. In the embodiment of FIGS. 1–4, each opening 42 takes the form of bore 44 having a circular cross-section as seen in FIG. 2A. In this embodiment, each of the retainer members has a special configuration, as best illustrated by 3A, for cooperation with each circular bore 44. The neck portion 30 of each retainer member 28 has a short, cylindrical configuration, the diameter thereof corresponding approximately to that of each bore 44. The head portion 32 includes a frusto-conical part 46, the smaller end of which merges into a convex area 48 forming the free end of the retainer.

To secure the band 40 to the base 26, each bore 44 in the band is brought into registry with one of the spaced retainer members 28. A downward pressure, in a direction perpendicular to the backing 26, is applied to the band 40 in the region of each bore. Initially, the convex free end 48 of each retainer 28 passes through the bore until the frusto-conical part 46 of the head portion 32 engages the sides of the bore 44. An application of downward pressure on the band causes deformation of the frusto-conical portion, compressing the same to reduce its diameter such that the head portion passes entirely through the bore 44. When the manually applied downward pressure is very light, the head portion 32 may deform only enough to pass partially through the bore 44. In such instances, the head portion can be further deformed to pass entirely through the bore 44 by the manual application of light lateral forces to that part of the head portion which has already passed through the bore 44 and which protrudes from the outer surface of the band 40. Preferably these light manual forces are applied by a "flickering" action which causes the retainer member to bend slightly, drawing the lower edge 49 thereof entirely through the bore 44.

It is to be understood that, while the thin band 40 is relatively flexible along its length, it may be considered rigid with respect to each resilient, easily deformable retainer member 28. That is, the head portion 32 of the retainer member 28 is extensively deformed during its passage through the bore but, at the same time, the area of the band 40 immediately surrounding the bore remains rigid and maintains a constant configuration.

Figure 3:
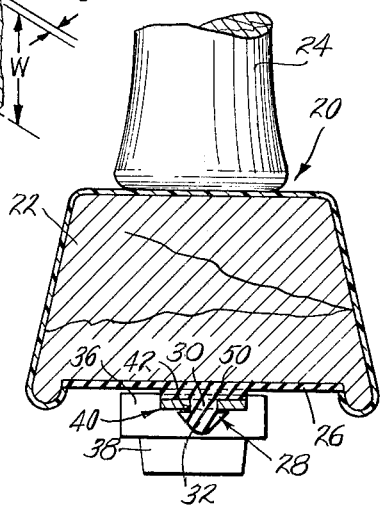
FIG. 3 is an enlarged fragmentary vertical sectional view, taken on the line 3—3 of FIG. 1.
Figure 3A:
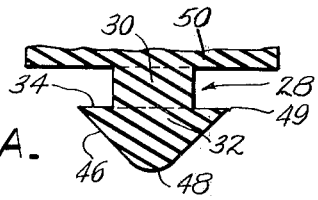
FIG. 3A is a fragmentary sectional view of the retainer member of FIG. 3.

After the head portion 32 has passed entirely through the bore 44, it elastically returns to its initial, relaxed position, as illustrated in FIGS. 3 and 3A. While the head portion regains its initial shape, the shoulder 34 comes into face-to-face engagement with the outer surface of the band 40 as seen in FIG. 3.

With the band thus secured, the neck portion 30 of the retainer 28 snugly fits within the bore 44. The band may be easily released from the retainer member by the application of an outward force in a direction generally perpendicular to the plane in which the backing member 26 is disposed. Such a force will cause deformation of the head portion 32 and particularly the annular shoulder 34 thereof, such that the band may be drawn over the head portion. Again, the area of the band 40 surrounding the bore 44 remains rigid relative to the head portion 32.

It has been discovered that a resilient retainer member having the above-described configuration, on the one hand, facilitates ready attachment and detachment of the band 40 to or from the backing member 26, but, on the other hand, provides a surprisingly strong and secure hold under lateral loads. That is, when a load is applied in a plane generally parallel to the plane of the backing member 26, the retainer member will strongly resist release. This is so, in part, because the short, cylindrical neck 30 of each retainer member 28, rather than the head portion 32 thereof, provides the principal reaction force against the lateral forces on each retainer member. The configuration of the neck portion is such as to resist extreme deformation thereof during the application of lateral forces.

The above-described properties of the retainer member 28 and of the corresponding bores 44 in each band 30, provide special advantages in both hand stamping and rotary printing applications. In both instances, it is lateral forces on the printing members which tend to dislodge the same from their backing. The retaining members of the present invention resist such forces with a structure which is extremely simple, which is easy to manufacture and which provides for easy attachment and detachment.

Figure 2A:
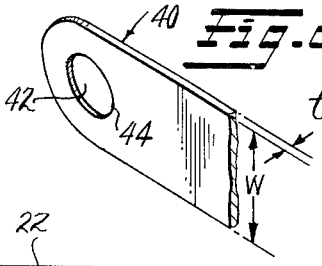
FIG. 2A is a fragmentary elevational view of one end of the band shown in FIG. 2.
Figure 2:
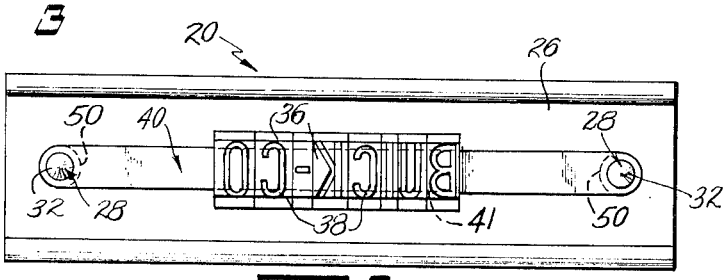
FIG. 2 is a bottom view of the device of FIG. 1.

Between the backing member 26 and each retainer member 28, there is disposed a base 50, as may be seen in FIGS. 1, 2 and 3. Each base 50 is raised from the surrounding backing member and, preferably, is integrally formed with both the backing member and the associated retainer member 28. Each base has a flat outer surface which engages the underside of each band 40 in the regions of the spaced openings 42 therein. In the embodiments of FIGS. 1–3, each base has a generally circular outer surface which corresponds in area to the undersurface of one end of a band. Each base member is at least as wide as the band which it engages.

The bases serve as supports for each end of a band and provide for a tight fit between the outer surface of the band (which is engaged by the shoulder 34 of the retainer) and the inner surface thereof (engaged by the base). Each base inhibits small displacements of the band, in a rotary fashion, about its longitudinal axis.

Figure 4:
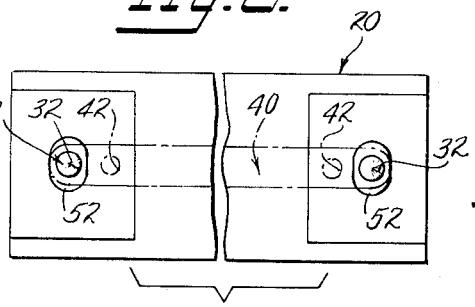
FIG. 4 is a fragmentary bottom view, similar to FIG. 2, showing a modified version of the device of the present invention.

FIG. 4 illustrates another type of base 52 which is elongated in a direction generally perpendicular to the longitudinal axis of the band 40. Here, the base 52 extends beyond the width of the band 40 to provide increased stability and greater resistance to displacements of the band about its longitudinal axis.

FIG. 4 also illustrates that more than one pair of holes 42 may be provided on each band 40 to accommodate different spacings of retainer members 28. Also, as shown in FIG. 4, the backing member may consist of a plurality of separate pieces. It is to be understood that, while a single pair of retainer members 28 and a single band 40 have been illustrated in connection with the hand stamp device of FIGS. 1–4, pluralities of retainer members and bands may also be used together on such a device.

Figure 5:
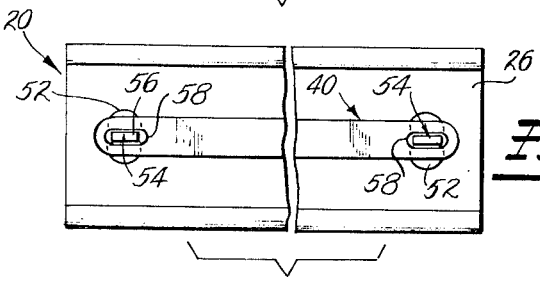
FIGS. 5 and 6 are fragmentary bottom views, illustrating still another modification of the device of the present invention and showing retainer members in two different positions of displacement.
Figure 6:
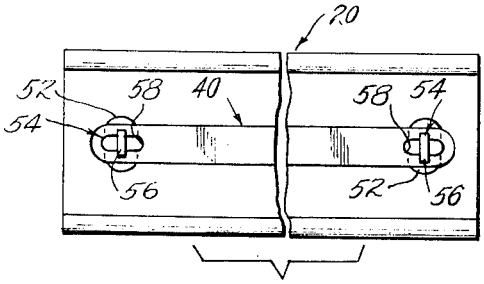
Figure 5A:
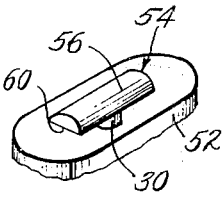
FIG. 5A is a fragmentary perspective view of a retainer member as shown in FIG. 5.

FIGS. 5, 5A and 6 show an alternative arrangement for securing the band 40 to the backing member 26. Here, a T-shaped retainer member, generally indicated by reference numeral 54 is used. The details of each retainer member 54 are best illustrated in FIG. 5A. Here, the neck portion 30 takes the same form as in the above-described retainer member 28. However, the head portion takes the form of an elongated member 56 having an axis disposed perpendicularly to the central axis of the short, cylindrical neck portion 30. In place of the circular bores 44 of the previously described embodiments, elongated openings 58 are provided adjacent the ends of the bands as illustrated in FIGS. 5 and 6. These openings generally correspond in size to the elongated head portions 56 of retainer members 54, but are slightly larger to facilitate easy passage of the head portions therethrough.

To secure the band 40 on the backing 26, each elongated opening 58 thereof is brought into registry with the corresponding elongated head portion 56 of retainer member 54. This may be accomplished by twisting the head portion through an arc of approximately 90° into a deformed position. The head portion 56 is then inserted through opening 58 and is allowed to return to its initial, relaxed position, wherein it will be misaligned with the elongated opening 58. Thus, the lower surface 60 of elongated member 56 (which surface is analogous to the shoulder portion 34 of the previously described embodiment) will engage the outer surface of the band 40 to secure the same against the base 52. Preferably, base 52 is of the same elongated type described above.

FIGS. 8–11 illustrate use of the mounting device of the present invention in rotary printing applications. Here, the body portion of the printing apparatus is a cylindrical printing drum 62 adapted for rotary movement. As illustrated, one or more bands 40, of the type described in connection with the previous embodiments, are secured to the roller 62 by retainer members 28 in the fashion described previously. While the mounting arrangement and retainer members 28 described in connection with the hand stamp device of FIGS. 1–4 are preferably used in the rotary applications of FIGS. 8–11, the retainer members 54 of FIGS. 5–6 could also be used here.

In the embodiment of FIG. 8, backing member 26 is mounted transversely across the face 64 of the printing drum 62. Here, the backing member 26 includes more than one pair of spaced retainer members 28 disposed thereon. The pairs are aligned so that, when the bands 40 are pressed into place in the manner previously described, the longitudinal axes of the bands will be disposed parallel to each other and parallel to the rotational axis of the drum 62.

In FIGS. 9 and 11, a different disposition of the backing and band is shown. Here, the band is disposed circumferentially around the exterior of the printing drum to provide an arrangement which is particularly suitable for securing large printing members 36. As can be seen most readily in FIG. 11, the foregoing circumferential disposition of band 40 on the drum 62 requires that the band 40 assume an arcuate configuration. Whereas, in the other embodiments, the band is preferably formed of metal, the band of FIGS. 9 and 11 is preferably formed of plastic which has been preformed into a curved, arcuate configuration corresponding to the curvature of the face 64 of the printing drum 62. By eliminating the radially outward components of direction which would be exerted at the ends of a straight metal band, the preformed band of FIGS. 9 and 10 will remain securely fastened to the retainer members even when large lateral forces develop during a printing operation. It is to be observed that the peripheral speed of the drum 62 in the embodiments of FIGS. 9 and 11 will exert a circumferential force on the band 40. With a preformed band, as illustrated, these circumferential forces will act laterally on the retainer members 28. As previously described, the retainer members 28 can well withstand these lateral forces.

The printing drum 62 of FIGS. 8–11 may include a pair of spaced, resilient rim members 66 protruding therefrom, but the use of such rim members is purely optional. As illustrated, each rim member 66 is disposed adjacent one end of the drum and is mounted upon a pad 68 affixed to the drum. Each rim member 66 and pad 68 circumferentially surround the drum at each respective spaced end location thereon.

As will be apparent from FIG. 11, the rim members 66 are of such size as to protrude radially from the drum face 64 a distance more than the retainer members 28 protrude therefrom. Rim members of this size prevent the possibility of the retainer members and bands directly contacting the sheet 70 when the drum 62 is rotated beyond the point where the printing members 36 are disposed. More importantly, however, rim members of the foregoing size provide a smooth rolling transition as the printing members 36 first come into contact with the surface to be printed upon. The rims 66 also effect a smooth transition as the printing members 36 come out of contact with the surface after the completion of a printing step. This is particularly important when printing upon sheets, such as corrugated cardboard 70, which may be easily crushed. It will be readily apparent that the rim members 66 elevate the drum face 62 from the work thereby substantially lessening the impact of the printing members 36 upon the work material as it is engaged and disengaged thereby.

Of course, the rim members 66 protrude radially from the drum face 64 a distance less than the distance which the outermost surfaces of the characters 38 protrude therefrom. Thus, the characters 38 will fully engage the work material 70 when rotated into contact therewith.

Figure 7:
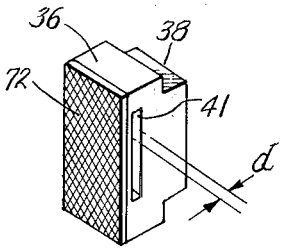
FIG. 7 is an enlarged perspective view of the rear of one of the printing members used with the device of the present invention.

In both hand-stamping and rotary printing applications, it is important that certain relationships exist between the height of the base members, 50 or 52, and the positioning of the elongated slot in each printing member. The distance $d$ (FIG. 7) between the rear surface 72 of each printing member and the rearwardmost side of the slot 41 therein should be approximately equal to the distance which each base, 50 or 52, protrudes from the backing 26. With this relationship, the band 40 will be maintained along its length at a constant distance from the backing member 26. This prevents any bending or bowing of the band which would, in turn, produce forces at the band ends tending to release the same from the retainer members 28. The foregoing dimensional relationship also insures that the band will lie flat upon each base member, thereby enhancing the secureness of the retaining action.

Another feature which contributes to the same result is the roughened texture of the rear surface 72 (FIG. 7) of each printing member 36. This roughened texture of the rear surface may be provided by affixing a fabric material, consisting of coarse cords or threads at the rear surface 72. The roughened rear surface 72 produces a gripping action between each printing member and the resilient backing 26, thereby effecting a more secure retension of the printing member.

It is of considerable significance that a very thin, flat band 40, having little lengthwise rigidity, is used in the device of the invention. The band 40 can be readily fabricated from very inexpensive stock material. Moreover, the thinness of the band permits substantial reductions in the dimensions of and amounts of material used in the other elements of the mounting device. In fact, it is only with a thin band that the small and extremely simple retainer members described above may be successfully used. In addition, the thinness of the band permits the printing members 36 to be relatively small in size, thereby requiring a minimum amount of material in their construction. Further, the thin, flat configuration of the band permits a maximum gripping area between the band and the slot in each printing member. This is another factor which enhances the secureness of the mounting. Finally, the thinness of the band effects an advantageously low-slung profile for the entire mounting device of the invention.

The band in question preferably has a thickness t (FIG. 2A) of approximately 0.020 – 0.030 inches. However, in some applications thicknesses ranging as much as 0.005 – 0.040 inches may be successfully used.

In terms of the relative relationship between the thickness *t* and the width *w* (FIG. 2A) of the band 40, the ratio of width to thickness is preferably about 16:1. In this regard, the overall ratio which may be successfully used ranges from about 5:1 to 35:1.

While throughout the above description, words such as "forward", "rearward", "inner" and "outer" have been used, it will be understood that these terms are used only to describe relative relationships and are not intended to be limiting. It will also be understood that those skilled in the art may make changes and modifications to the above-described embodiments of the invention without departing from the spirit and scope thereof.

What is claimed is:

1. A device for mounting interchangeable type comprising:

a. a backing member;

b. a body portion upon which said backing member is mounted;

c. a pair of spaced, resilient retainer members disposed on said backing member, each retainer member having a neck portion and a head portion, said head portion defining a shoulder between said neck and head portions;

d. an elongated band having a pair of openings therein, said openings being spaced the same distance as said resilient retainer members to receive the head portions of said resilient retainer members with one side of said band in contact with said shoulder, said elongated band being thin relative to its width, the ratio of the width of said band to the thickness thereof being at least 5:1;

e. a base disposed between said backing member and each of said retainer members, each base protruding from said backing member so as to contact said band on the side of said band opposite to the side that contacts said shoulder;

f. a plurality of printing members, each printing member having a character formed thereon and each having a slot through which said band may be passed, each printing member having a rear side disposed opposite said character, the distance between said rear side of each printing member and a rearwardmost side of each slot being approximately equal to the distance said base protrudes from said backing member.

2. A device as defined in claim 1 wherein said band, at least in the region of said openings, is rigid in relation to the resilient retainer members, whereby only said retainer members are deformed when passed through said openings in said band.

3. A device as defined in claim 1 wherein said retainer members are integral with said backing member.

4. A device as defined in claim 1 wherein each base is of such area as to contact the entire width of said band in the region of each of said openings.

5. A device as defined in claim 1 wherein each base has a width greater that the width of said band.

6. A device as defined in claim 1 wherein said backing member, said retainer members and said bases are integrally formed.

7. A device as defined in claim 1 wherein the head portion of each retainer member includes a frusto-conical portion adjacent said neck and a convex portion forming the free end of each retainer member, said frusto-conical portion defining an annular shoulder between said neck and said head portion to retain said band on said backing member.

8. A device as defined in claim 1:

a. wherein said head portion is elongated in a direction perpendicular to the axis of said neck;

b. wherein said openings in said band are elongated;

c. each head portion being rotatable into alignment with one of said openings for passage therethrough and then rotatable out of alignment with said one opening to secure said band on said backing member.

9. A device as defined in claim 8 wherein each retainer member is movable between a relaxed position and a deformed position, each head portion being in misalignment with one of said slots in said relaxed position and in alignment therewith in said deformed position.

10. A device as defined in claim 1, wherein each printing member is resilient and said slot means passes therethrough, said band extending through each slot means in tightly fitting, resilient relationship to secure said printing members on said band.

11. A device as defined in claim 10 wherein said rear side of each printing member has a rough texture for grippingly engaging said backing member.

12. A device as defined in claim 1 wherein said backing member comprises a plurality of spaced sections.

13. A device as defined in claim 1 wherein said body portion includes a handle thereon, whereby said device may be used as a hand stamp.

14. A device as defined in claim 1 wherein said body portion comprises a rotatable drum having a curved face thereon, said backing member being mounted on said curved face.

15. A device as defined in claim 14 wherein said band is disposed on said drum in parallel relationship with respect to the axis of rotation of said drum.

16. A device as defined in claim 14 wherein said band is disposed circumferentially on said drum.

17. A device as defined in claim 16 wherein said band has a preformed curvature along its length, said preformed curvature corresponding approximately to the curvature of said drum face.

18. A device as defined in claim 14 wherein said drum includes a pair of circumferentially disposed, protruding rim members thereon, each rim member being located adjacent one end of said drum, said rim members protruding radially from said curved face a distance more than the distance which said retainer members protrude from said surface but less than the distance which said characters protrude therefrom.

19. A device as defined in claim 1 wherein said ratio of the width of said band to the thickness thereof is approximately 16:1.

20. A device as defined in claim 1 wherein the thickness of said band is between 0.020 and 0.030 inches.

21. A device as defined in claim 1 wherein each retainer member has a solid cross-section.

* * * * *